US011826298B2

(12) United States Patent
Holgate et al.

(10) Patent No.: US 11,826,298 B2
(45) **Date of Patent: *Nov. 28, 2023**

(54) PRELOADED PERSONAL AUGMENTATION SUIT AND METHOD FOR ASSISTED HUMAN MOTION

(71) Applicant: SpringActive, Inc., Tempe, AZ (US)

(72) Inventors: Matthew A Holgate, Mesa, AZ (US); Jeffrey A. Ward, Phoenix, AZ (US); Chase Wheeler, Mesa, AZ (US); Dustin Vehon, Mesa, AZ (US)

(73) Assignee: SpringActive, Inc., Tempe, AZ (US)

( * ) Notice: Subject to any disclaimer, the term of this patent is extended or adjusted under 35 U.S.C. 154(b) by 168 days.

This patent is subject to a terminal disclaimer.

(21) Appl. No.: 16/655,221

(22) Filed: Oct. 16, 2019

(65) Prior Publication Data

US 2021/0113412 A1 Apr. 22, 2021

(51) Int. Cl.
*A61H 1/02* (2006.01)
*A61H 1/00* (2006.01)

(52) U.S. Cl.
CPC ..... *A61H 1/0255* (2013.01); *A61H 1/00* (2013.01); *A61H 2201/0173* (2013.01);
(Continued)

(58) Field of Classification Search
CPC ..... A61H 1/0255; A61H 1/00; A61H 2201/1652; A61H 2205/102;
(Continued)

(56) References Cited

U.S. PATENT DOCUMENTS 807,908 A * 12/1905 Bradstreet ..... A63B 22/001 482/51
1,544,162 A * 6/1925 La Vigne ..... A61F 5/02 2/44

(Continued)

FOREIGN PATENT DOCUMENTS

WO 2014194257 A1 4/2014
WO 2014109799 A1 7/2014

OTHER PUBLICATIONS

"Delta Harness," Harnessland, Mar. 28, 2014. (Year: 2014).*

*Primary Examiner* — Timothy A Stanis
*Assistant Examiner* — Benjamin M. Kusiak
(74) *Attorney, Agent, or Firm* — Robert D. Atkins; PATENT LAW GROUP

(57) ABSTRACT

A human motion assistance device has an upper torso harness and a preloaded leg strap arrangement affixed to the upper torso harness. The preloaded leg strap arrangement has an X-bracket connected to the upper torso harness. The preloaded leg strap arrangement further uses a plurality of blocks and a preloaded strap routed through the blocks and connected to the X-bracket. The preloaded leg strap arrangement further uses a knee pad with a split seam. The preloaded strap is under tension, even when the human motion assistance device is in a relaxed state. The preloading provides an immediate force which increases under a loaded state. The potential energy stored during the loaded state is released when transitioning from a standing position to a crouched, squatting, or seated position. The configuration allows for maximizing the energy storage without putting excess shoulder pressure on the user when standing.

20 Claims, 11 Drawing Sheets

(52) U.S. Cl.
CPC ..... *A61H 2201/1269* (2013.01); *A61H 2201/165* (2013.01); *A61H 2201/1652* (2013.01); *A61H 2203/0406* (2013.01); *A61H 2203/0418* (2013.01); *A61H 2205/102* (2013.01); *A61H 2205/108* (2013.01)

(58) Field of Classification Search
CPC .... A61H 2203/0418; A61H 2201/0173; A61H 1/02; A61H 2201/1269; A61H 2201/165; A61H 2203/0406; A61H 2205/106; A61H 2205/108; A61H 1/0292; A61H 1/0237; A61H 1/024; A61H 1/0244; A61H 2201/0157; A61H 2201/1253; A61H 2201/1619; A61H 2201/1623; A61H 2201/1628; A61H 2205/10; A61H 2205/08; A61H 2205/081; A61H 2205/088; A63B 21/065; A63B 21/4001; A63B 21/4007; A63B 21/4009; A63B 21/4025
USPC ..... 601/1
See application file for complete search history.

(56) References Cited

U.S. PATENT DOCUMENTS 3,295,517 A 1/1967 Stevens
3,411,500 A 11/1968 Gatts
4,813,080 A 3/1989 Toso
5,652,957 A 8/1997 Williford et al.
5,716,307 A * 2/1998 Vadher ..... A43B 7/20 482/124
5,857,947 A 1/1999 Dicker et al.
5,993,362 A 11/1999 Ghobadi
6,099,445 A 8/2000 Rovinsky et al.
6,129,691 A 10/2000 Ruppert
6,213,922 B1 * 4/2001 Afanasenko ..... A61F 5/01 482/124
6,436,065 B1 8/2002 Mitchell
6,450,131 B1 9/2002 Broman
7,553,266 B2 6/2009 Abdoli-Eramaki
7,744,511 B2 6/2010 Grigoriev et al.
7,757,305 B2 7/2010 Toso
7,931,571 B2 * 4/2011 Bernardoni ..... A61F 5/0102 482/124
9,144,252 B1 9/2015 Kostrzewski
9,351,900 B2 5/2016 Walsh et al.
10,166,426 B2 * 1/2019 Adeeko, Jr. ..... A63B 21/0557
10,772,785 B2 * 9/2020 Holgate ..... B25J 9/1075
10,843,332 B2 * 11/2020 Walsh ..... A61H 1/0266
11,559,420 B2 1/2023 Holgate et al.
2003/0092545 A1 5/2003 Koscielny et al.
2006/0048998 A1 3/2006 Wolner et al.
2006/0229175 A1 10/2006 Frappier
2007/0004570 A1 * 1/2007 Afanasenko ..... A61F 5/01 482/124
2007/0135279 A1 6/2007 Purdy et al.
2009/0011909 A1 1/2009 Gilsan
2009/0057360 A1 3/2009 Demsky
2010/0125230 A1 * 5/2010 Hurley ..... A61F 5/026 602/19
2010/0281594 A1 11/2010 Paterno
2010/0298746 A1 11/2010 Shimizu et al.
2013/0045842 A1 * 2/2013 Wood ..... A63B 21/00185 482/124
2013/0190147 A1 7/2013 Luo et al.
2013/0288863 A1 * 10/2013 Yamamoto ..... A63B 21/4011 482/124
2013/0319793 A1 * 12/2013 Stibilj ..... A62B 35/0012 182/3
2014/0208490 A1 7/2014 Freixas
2015/0173993 A1 * 6/2015 Walsh ..... A61F 2/68 414/4
2015/0321339 A1 11/2015 Asbeck et al.
2016/0107309 A1 * 4/2016 Walsh ..... A61H 1/0266 248/550
2016/0183606 A1 6/2016 Shriver
2016/0220438 A1 8/2016 Walsh et al.
2016/0346156 A1 12/2016 Walsh et al.
2017/0027735 A1 2/2017 Walsh et al.
2018/0093374 A1 * 4/2018 Holgate ..... B25J 9/1075
2019/0030708 A1 1/2019 Holgate et al.
2019/0343670 A1 * 11/2019 Ruprecht ..... A63B 21/0557
2020/0289357 A1 * 9/2020 Sato ..... A61H 1/0281
2021/0077839 A1 * 3/2021 Arai ..... B25J 9/0006

* cited by examiner

PRELOADED PERSONAL AUGMENTATION SUIT AND METHOD FOR ASSISTED HUMAN MOTION

FIELD OF THE INVENTION

The present invention relates in general to a human assistance device, and more particularly, to a preloaded personal augmentation suit and method for assisted human motion.

BACKGROUND OF THE INVENTION

A variety of human assistance devices provide aid for human motion. Some work tasks and activities demand frequent and heavy lifting or long-term strenuous movement, beyond normal unassisted physical exertion, and can lead to exhaustion and potential injury. In particular, excessive strain on muscles and joints can cause injury to the back, legs, and knees with associated reduction in productivity, lost time from work, and higher health costs. The human assistance device, as worn by the user, is designed to overcome or compensate for the added load or strain and make many work tasks easier to perform with less risk of injury.

In one embodiment, the human assistance device uses an exoskeleton with rigid components e.g., linkages and joints, attached to the user's body. The exoskeleton joints are positioned to have an axis of rotation collinear with a natural axis of rotation for adjacent joints. The rigid exoskeleton relies on a framework of linkages connected to the body at select locations via pads and straps to provide the ability to augment human movements that need assistance or otherwise enhance the user's performance, stability, balance, and safety. As the user flexes or extends his limbs, these rigid links move in parallel with the limb, adding considerable inertia to movement. Unfortunately, the rigid exoskeleton also causes considerable restriction to the user's range of motion and impedes natural and fluid movement.

In another example, U.S. patent publication 2015/0321339 discloses a soft exosuit that generates forces about one or more joints based on anchor elements and connection elements disposed between the anchor elements. The exosuit uses sensors to determine forces on the anchor or connection elements. Actuators are configured to change tension in the soft exosuit in response to the sensors. The exosuit tends to be complex with an overreliance on active components, such as sensors and actuators, to control its operation. The intricate interconnection of anchor elements, connection elements, sensors, and actuators tends to be expensive to manufacture, difficult to configure, slow in response, and overall low reliability.

DETAILED DESCRIPTION OF THE DRAWINGS

The present invention is described in one or more embodiments in the following description with reference to the figures, in which like numerals represent the same or similar elements. While the invention is described in terms of the best mode for achieving the invention's objectives, those skilled in the art will appreciate that the description is intended to cover alternatives, modifications, and equivalents as may be included within the spirit and scope of the invention as defined by the appended claims and their equivalents as supported by the following disclosure and drawings.

Figure 1A:
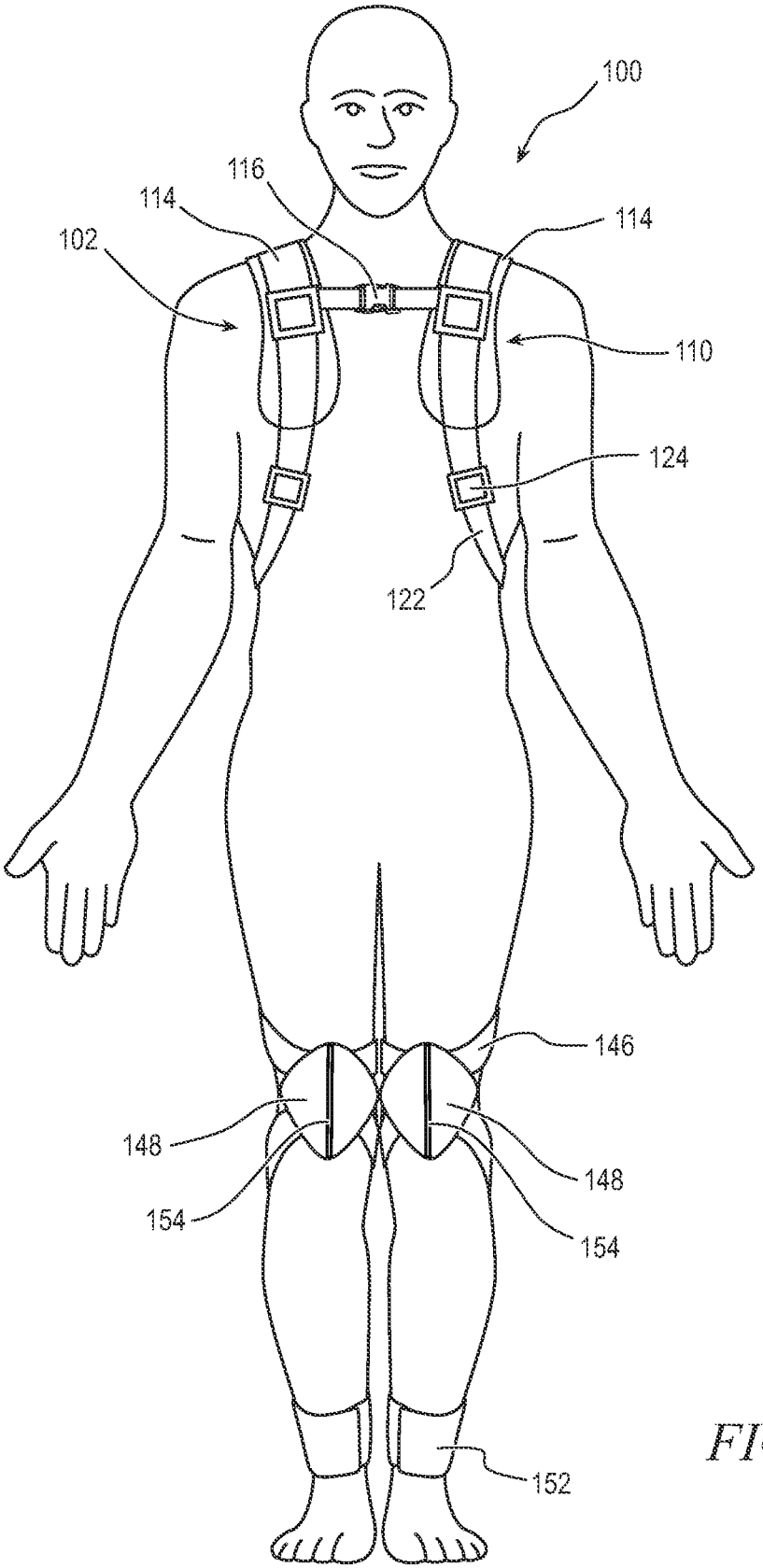
FIGS. 1*a*-1*c* illustrate front, back, and side views of a passive P2K suit with a backpack assembly, preloaded leg strap arrangement, split knee pad, and ankle cuffs.
Figure 1B:
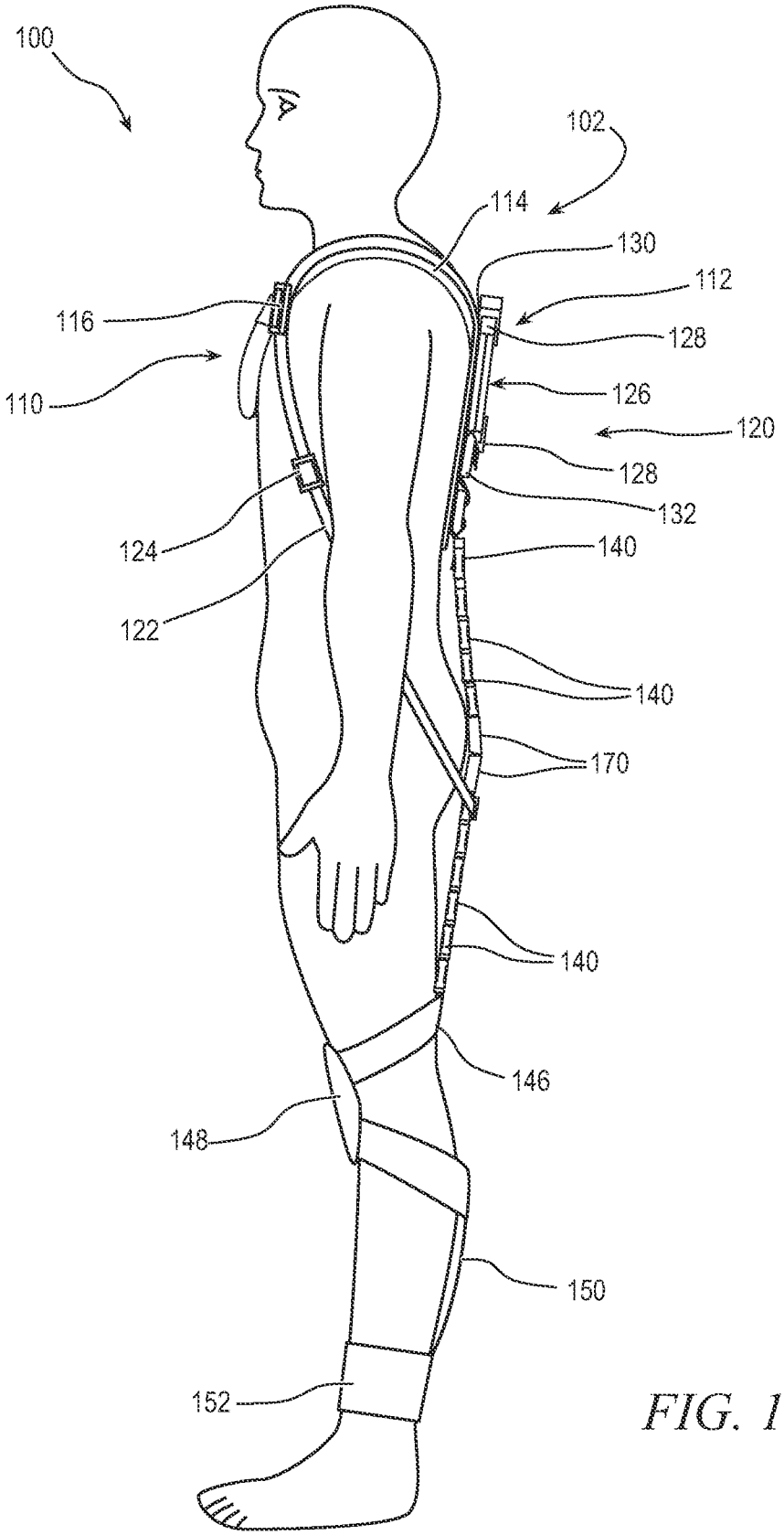
Figure 1C:
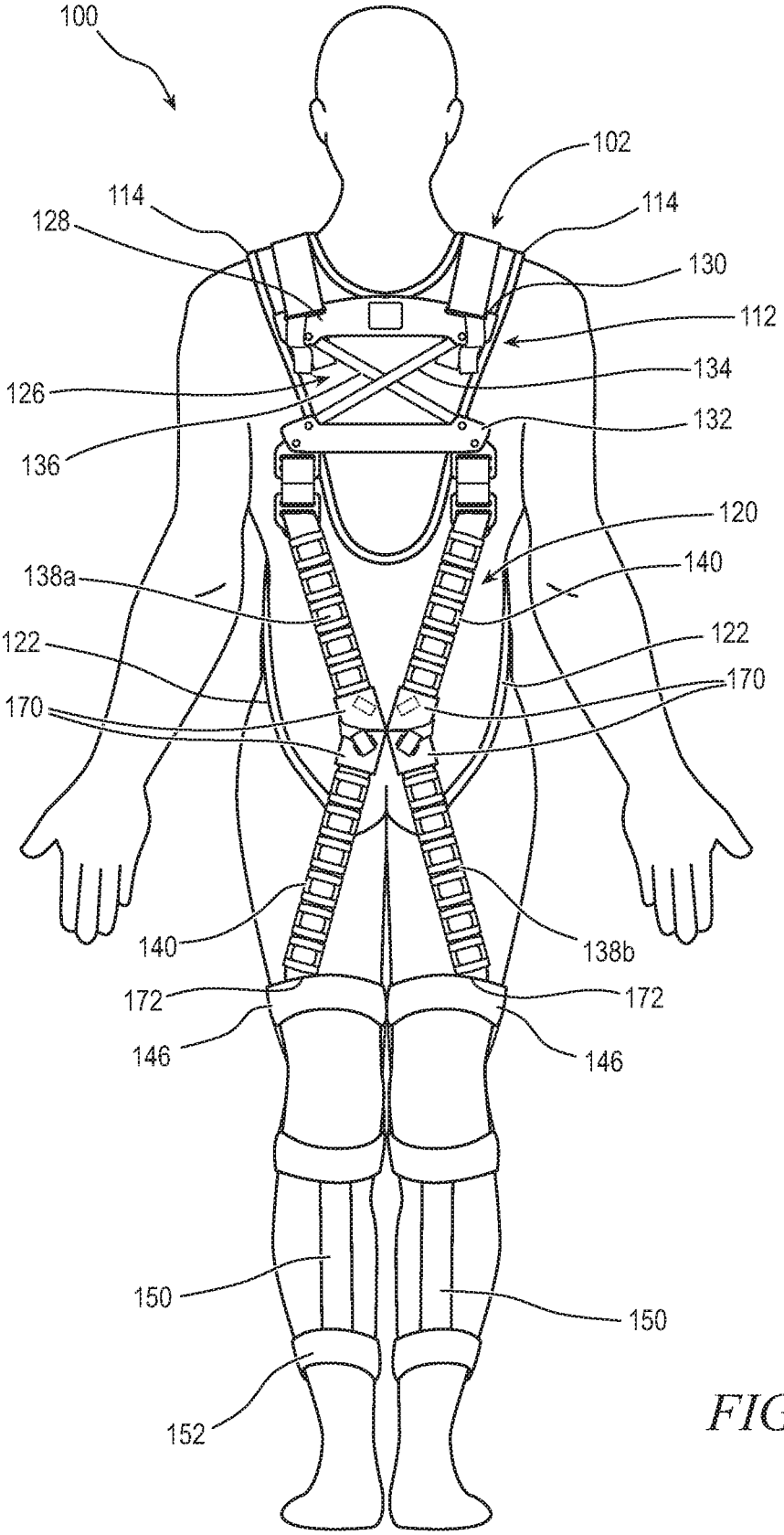

FIGS. 1*a*-1*c* show front, side, and back views, respectively, of user 100 wearing potential-to-kinetic suit (P2K) 102 suitable for human assistance in crouching, squatting, sitting, standing, and lifting under load. P2K 102 is a passive personal augmentation suit or strapping system, i.e., no active components, applicable to many types of human activity and physical work, such as moving heavy articles, up and down motion under load, and other repetitive, long-term physical exertion. P2K 102 is capable of storing potential energy in the strapping arrangement, e.g., potential energy is stored in elastic strapping when transitioning from a standing position to a crouched or squatting position. The potential energy in P2K 102 is released when user 100 moves from the crouched or squatting position to return upright in stance, thereby assisting the user in the motion, particularly while under load. P2K 102 is preloaded, as described infra, to immediately assist with mobility. P2K 102 increases endurance, reduces fatigue, and decreases potential for injury associated with such activity, particularly for the user's back, legs, and knees. P2K 102 includes an interconnected arrangement of preloaded elastic straps, blocks, anchors, and buckles to provide passively loaded support and reaction for user 100 while assisting with human motion under load. Portions of P2K 102 can be reflective material for safety.

FIG. 1*a* is a front view of P2K 102 showing upper torso harness 110 with shoulder straps 114; FIG. 1*b* is a side view of P2K 102 including backpack assembly 112; FIG. 1*c* is a back view of P2K 102. Backpack assembly 112 can include a combination of durable materials such as textured nylon, polyurethane coated polyester, and rigid plastic or polymer inserts, as well as elastic material and webbing material. Backpack assembly 112 can be made with an air mesh material with openings to allow for air-flow on the back and reduce the overall weight. Backpack assembly 112 covers a portion of back area of user 100 to improve ergonomics and comfort, relieve lower back pressure, and ease of donning and doffing. Shoulder straps 114 extend over the shoulder and affix to backpack assembly 112 with sewing, rivets, belt, buckles, buttons, snaps, hooks, adhesive, VELCRO®, or other secure attachment mechanism, as shown in FIG. 1*b*. Shoulder straps 114 are made with elastic material or webbing material and can slide, loosen, or tighten relative to backpack assembly 112 for user comfort and adapting to movement. Buckle 116 in shoulder straps 114 provides adjustment and attachment points. Buckle 116 snaps to lock and enable P2K 102 to fit different body sizes.

In FIG. 1*c*, backside preloaded strap arrangement 120 includes X-bracket 126 with an upper bar 128 connected to backpack assembly 112 at connection location 130 with sewing, rivets, belt, buckles, buttons, snaps, hooks, adhesive, VELCRO®, or other secure attachment mechanism. Upper bar 128 connects to lower bar 132 with crossing members 134 and 136 to allow lower bar 132 to move or rock based on relative motion of preloaded straps 138*a* and 138*b*. Backside preloaded strap arrangement 120 slides or moves relative to backpack assembly 112 to enable or minimize medial/lateral relative motion. Shoulder straps 114 anchor to backpack assembly 112, and side straps 122 extend from backpack assembly 112 under the arms and along the side torso of user 100 to backpack assembly 112 or backside preloaded strap arrangement 120. Side straps 122 can include elastic material with buckles 124 for adjustments and comfort.

Figure 2:
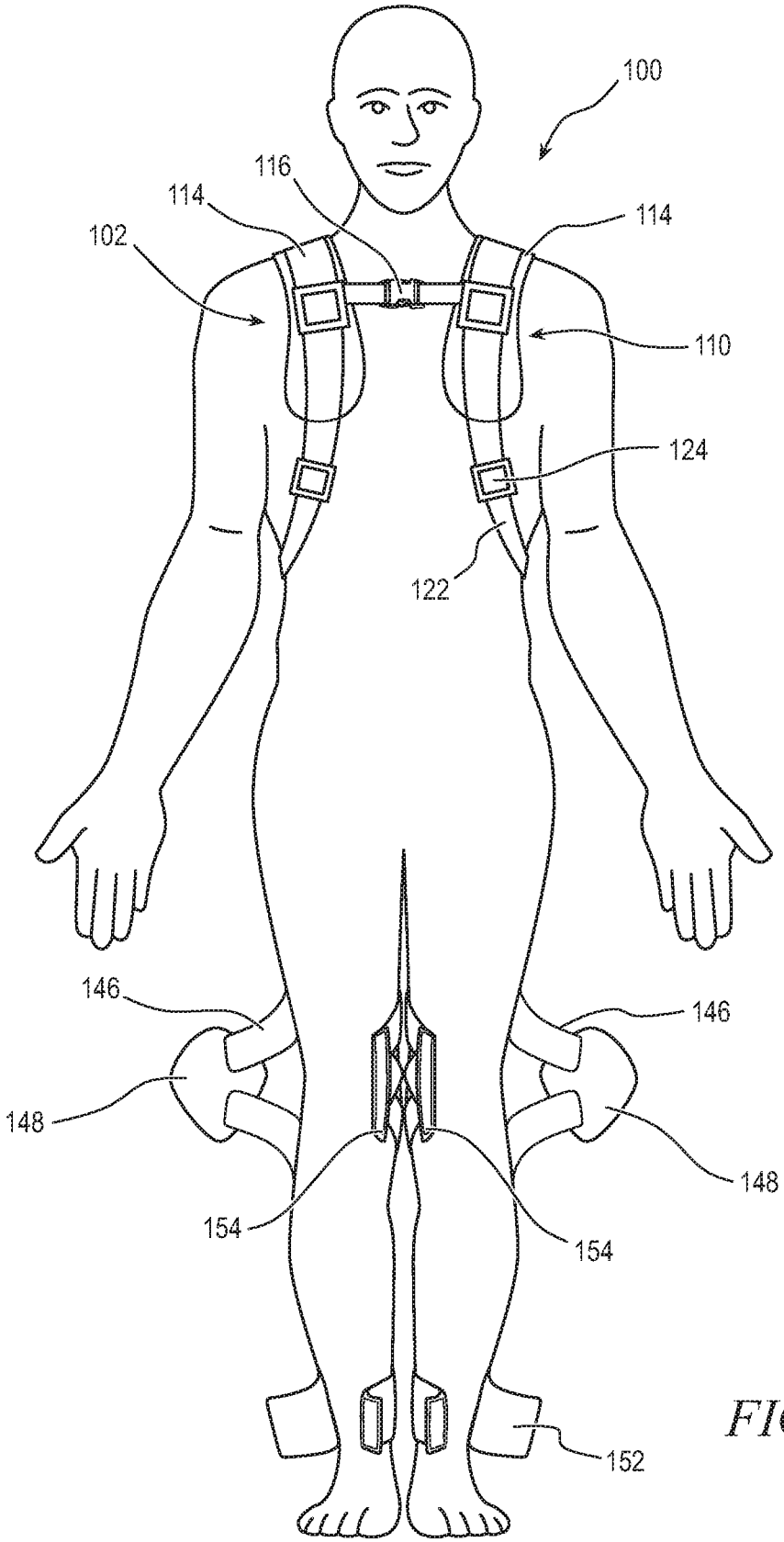
FIG. 2 shows the split knee pad open for ease of donning and doffing.

Preloaded straps 138*a* and 138*b* with blocks 140 are substantially aligned along the back of user 100 and extend down the legs of user 100 to thigh straps 146, which connect to a portion of knee pads 148. Calf straps 150 connect between a portion of knee pads 148 and ankle cuffs 152. Knee pads 148 provide padding and protection of the knee while kneeling on the ground. Knee pads 148 open or split along vertical or angled seam 154 and close with buttons, snaps, hooks, VELCRO®, or other secure attachment mechanism for ease of donning and doffing P2K 102, as shown in FIG. 2. Likewise, ankle cuffs 152 open or split and close with buttons, snaps, hooks, VELCRO®, or other secure attachment mechanism for ease of donning and doffing P2K 102. In one embodiment, knee pads 148 open and close with a magnetic strip connection along seam 154. When the magnetic strips are brought into close proximity, knee pads 148 readily close with the magnetic attraction. A similar magnetic connection can be made for ankle cuffs 152 and backpack assembly 112.

Figure 3:
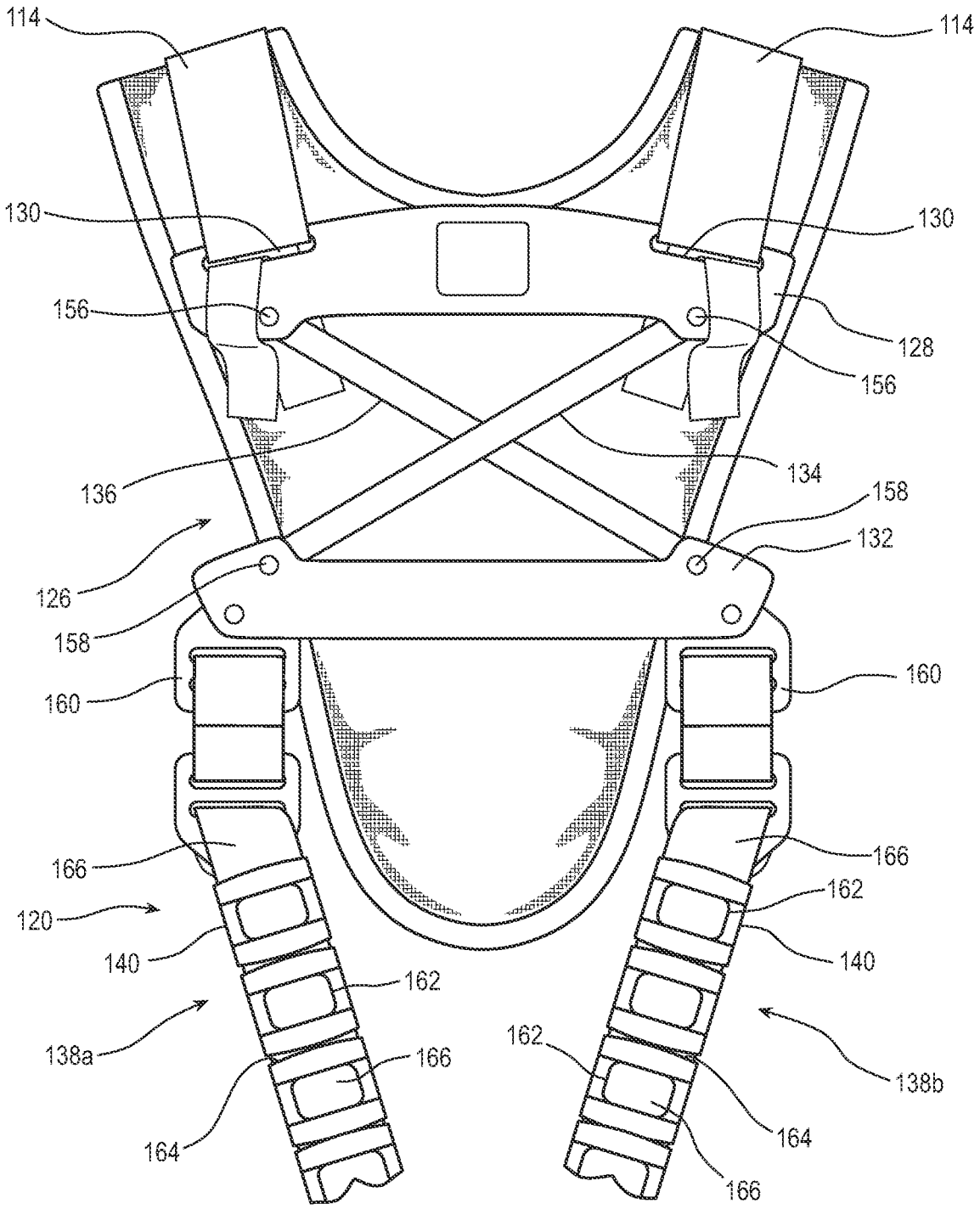
FIG. 3 illustrates a portion of preloaded leg strap arrangement with an X-bracket and preloaded strapping.

FIG. 3 shows further detail of X-bracket 126 attached to backside preloaded strap arrangement 120 with an upper bar 128 connected to shoulder straps 114 at connection location 130 with sewing, rivets, belt, buckles, buttons, snaps, hooks, adhesive, VELCRO®, or other secure attachment mechanism. Upper bar 128 provides a horizontal anchor between shoulder straps 114. Crossing members 134 and 136 connect to upper bar 128 with revolute joint or rivets 156 to allow the cross members to rotate with respect to upper bar 128. Crossing members 134 and 136 also connect to lower bar 132 with revolute joint or rivets 158 to allow the cross members to rotate with respect to lower bar 132. Accordingly, lower bar 132 is free to move or rock in a differential manner with respect to upper bar 128 depending on the relative motion of preloaded straps 138*a* and 138*b*. That is, strap 138*a* moves up while strap 138*b* moves down, and visa versa.

Preloaded straps 138*a* and 138*b* connect to lower bar 132 of X-bracket 126 with upper anchor buckles 160 using sewing, rivets, belt, buckles, buttons, snaps, hooks, adhesive, VELCRO®, or other secure attachment mechanism. Preloaded straps 138*a* and 138*b* use a plurality of individual blocks 140 with openings 162 and rounded or curved contacting ends 164. Elastic or stretchable strapping 166 connects to upper anchor buckles 160 and extends through blocks 140. Blocks 140 maintain the preload on strapping 166.

Figure 4:
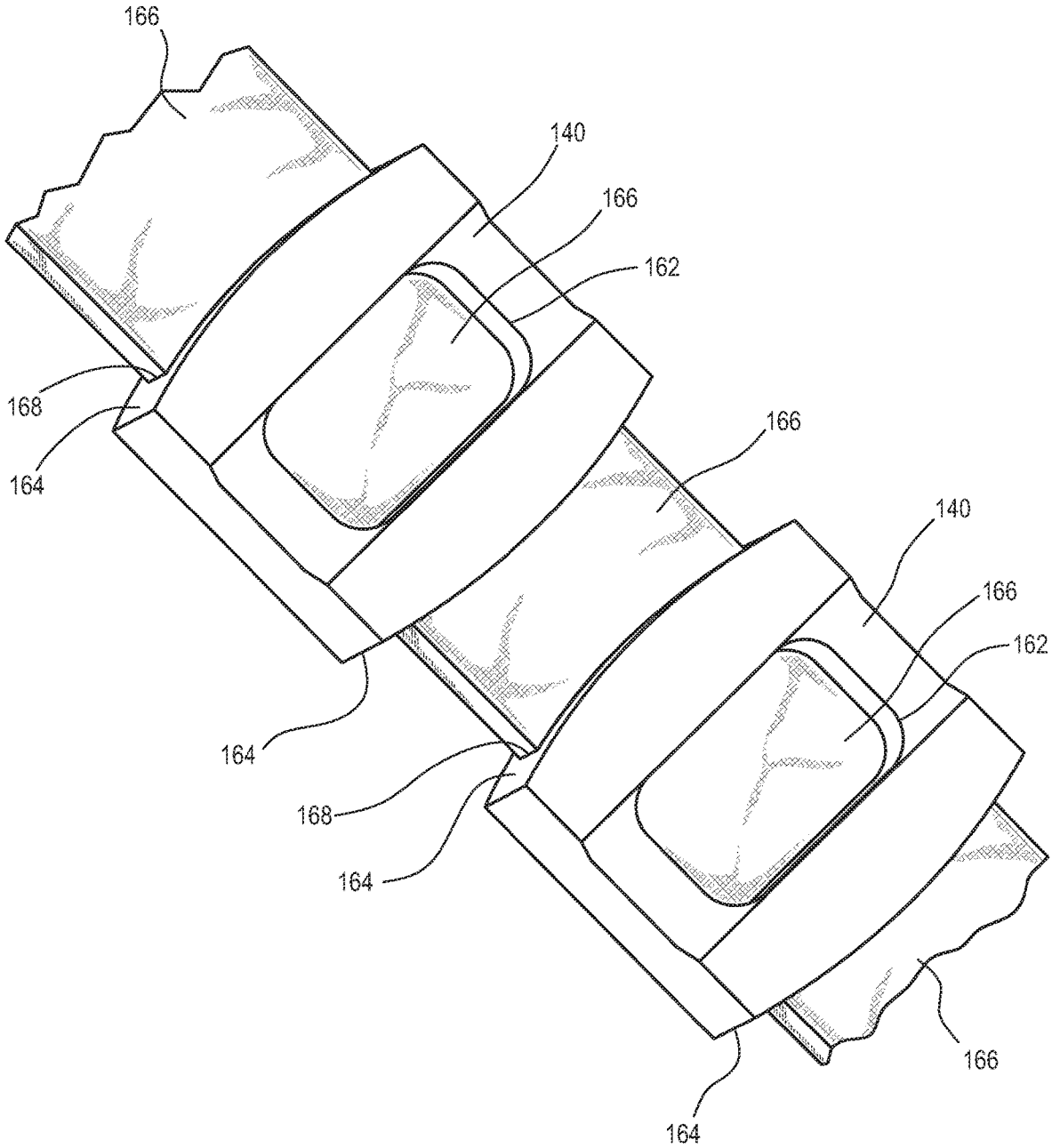
FIG. 4 illustrates further detail of the preloaded strap with blocks and elastic strapping under tension.

FIG. 4 illustrates further detail of elastic strapping 166 extending through openings 168 of block 140. Elastic strapping 166 does not connect or anchor to any particular block 140, but rather block 140 freely slides over elastic strapping 166 within openings 168. Elastic strapping 166 is visible through opening 162. Straps 138*a* and 138*b* are preloaded with tension, even when P2K 102 is in a relaxed state, i.e., user 100 upright. The preloading involves stretching elastic straps 166 prior to attachment to upper anchor buckle 160, mid-anchor buckles 170, and thigh strap 146. The spacing of blocks 140, when touching end 164 of one block 140 to end 164 of an adjacent block 140, sets a minimum length of preloaded straps 138*a* and 138*b*. The preload arises from elastic strapping 166 being stretched beyond the minimum length of straps 138*a* and 138*b* due to blocks 140. Accordingly, blocks 140 maintain the preload of elastic strapping 166 and keep preloaded straps 138*a* and 138*b* under constant tension, again even with P2K 102 in a related state.

Figure 5:
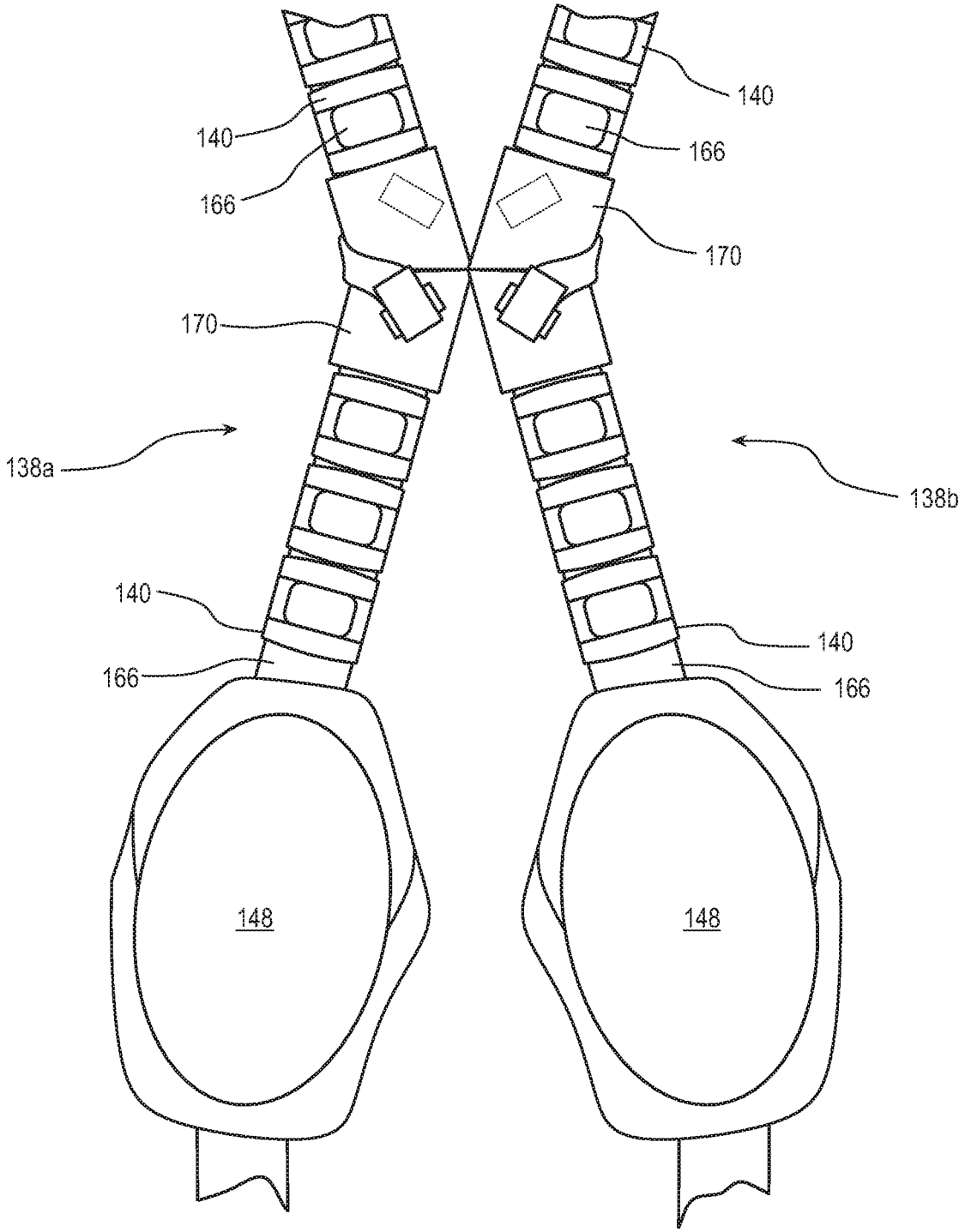
FIG. 5 illustrates the preloaded straps connected between the X-bracket and split knee pads.

FIG. 5 illustrates preloaded straps 138*a* and 138*b* connected to upper anchor buckle 160 continuing from FIG. 3 and further connected to mid-anchor buckles 170 using sewing, rivets, belt, buckles, buttons, snaps, hooks, adhesive, VELCRO®, or other secure attachment mechanism. Mid-anchor buckles 170 have a 30-45 degree angle and are positioned proximate to the lower back of user 100. Preloaded straps 138*a* and 138*b* continue from mid-anchor buckle 170 to connection point 172 on thigh straps 146 and are secured using sewing, rivets, belt, buckles, buttons, snaps, hooks, adhesive, VELCRO®, or other secure attachment mechanism.

Figure 6:
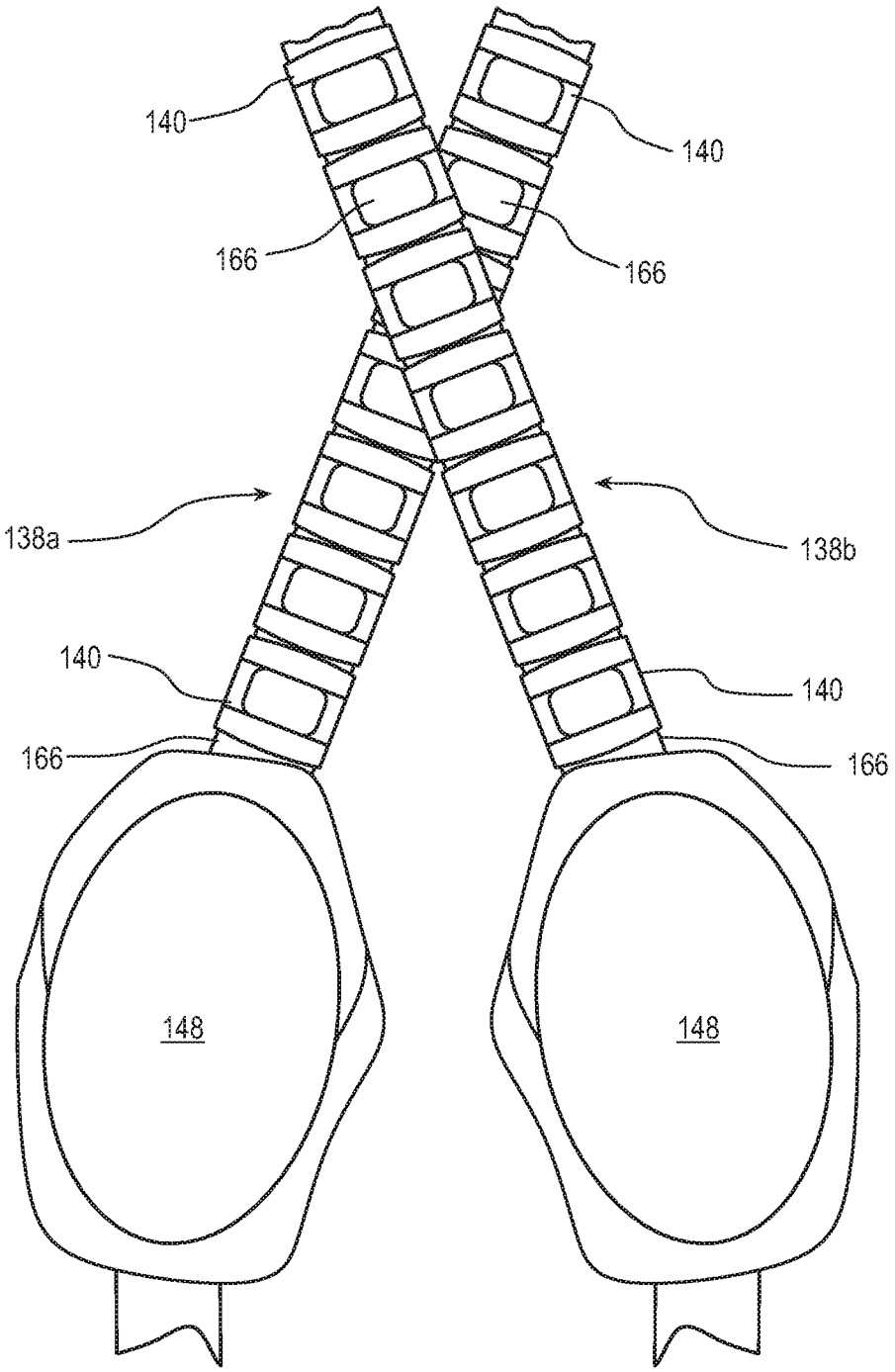
FIG. 6 illustrates another embodiment of the preloaded straps connected between the X-bracket and split knee pads.

FIG. 6 illustrates another embodiment of preloaded straps 138*a* and 138*b* connected to upper anchor buckle 160 continuing from FIG. 3 and further connected to thigh straps 146 using sewing, rivets, belt, buckles, buttons, snaps, hooks, adhesive, VELCRO®, or other secure attachment mechanism. Preloaded straps 138*a* and 138*b* continue straight through to the opposite limb, i.e. left shoulder strap 114 connects to right thigh strap 146 and right shoulder strap 114 connects to left thigh strap 146.

Figure 7C:
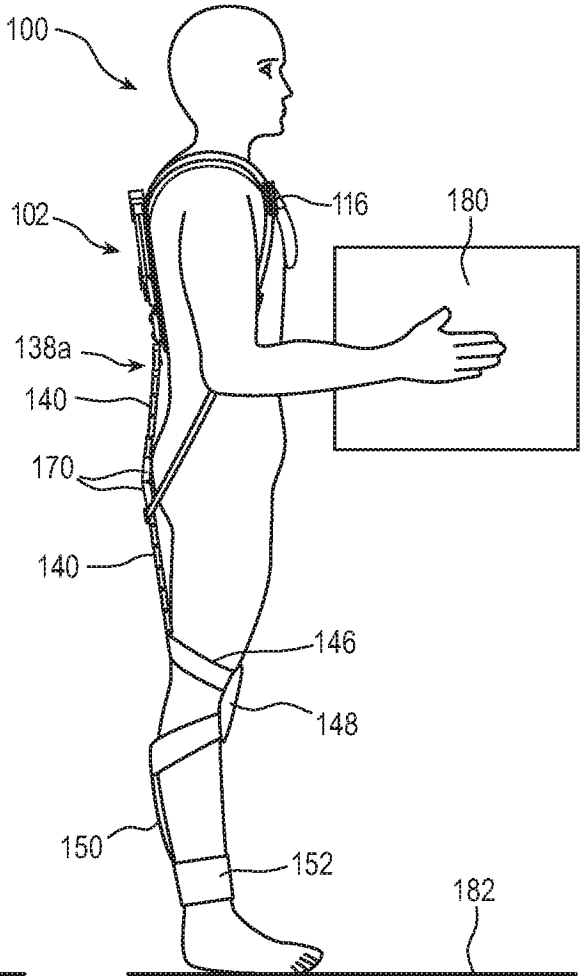
FIGS. 7*a*-7*c* illustrate various positions of the user wearing the passive P2K suit to lift a load.
Figure 7B:
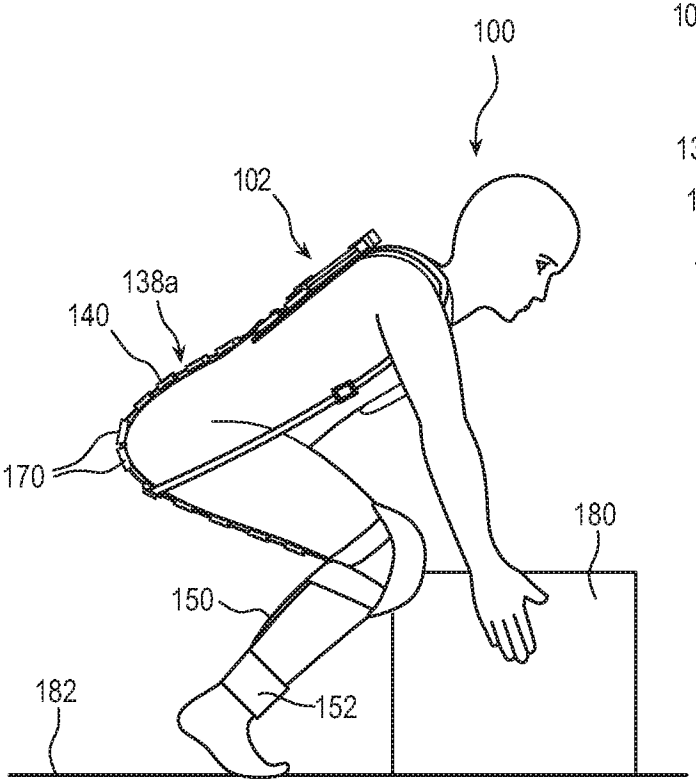
Figure 7A:
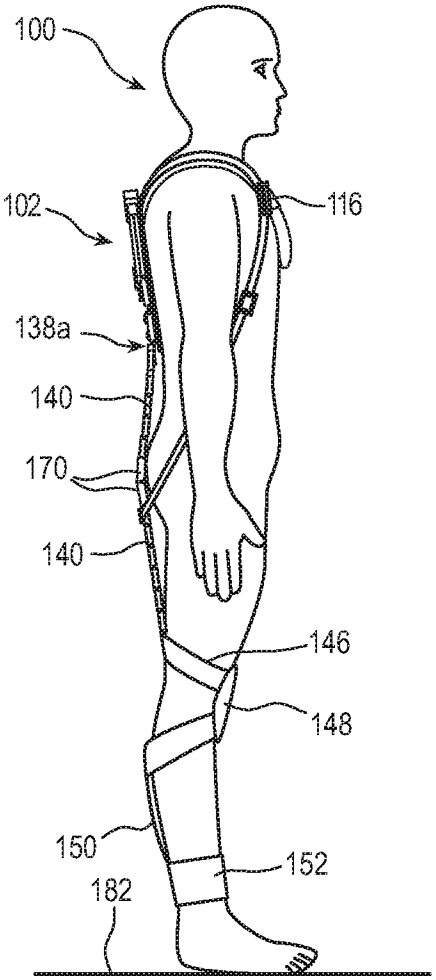
Figure 8A:
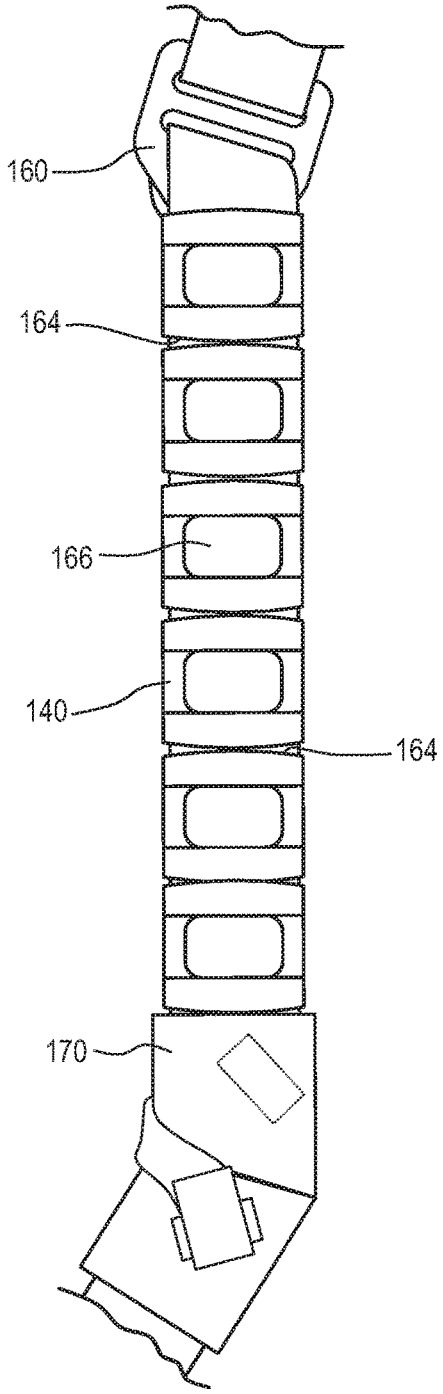
FIGS. 8*a*-8*b* illustrate the preloaded straps under a relaxed state and loaded state.

FIG. 7*a* shows user 100 in a standing position with no load. P2K 102 is in a relaxed state but with straps 138*a* and 138*b* preloaded by stretching elastic straps 166. FIG. 8*a* corresponds to a relaxed but with a preloaded state of straps 138*a* and 138*b*. There is no load on the shoulders of user 100 even with straps 138*a* and 138*b* preloaded. Blocks 140 are held together and contact on rounded or curved ends 164 due to the preloading on elastic strapping 166, as shown in FIG. 8*a*. Curved ends 164 provide free and natural movement of the straps 138*a* and 138*b* in its preloaded state.

Figure 8B:
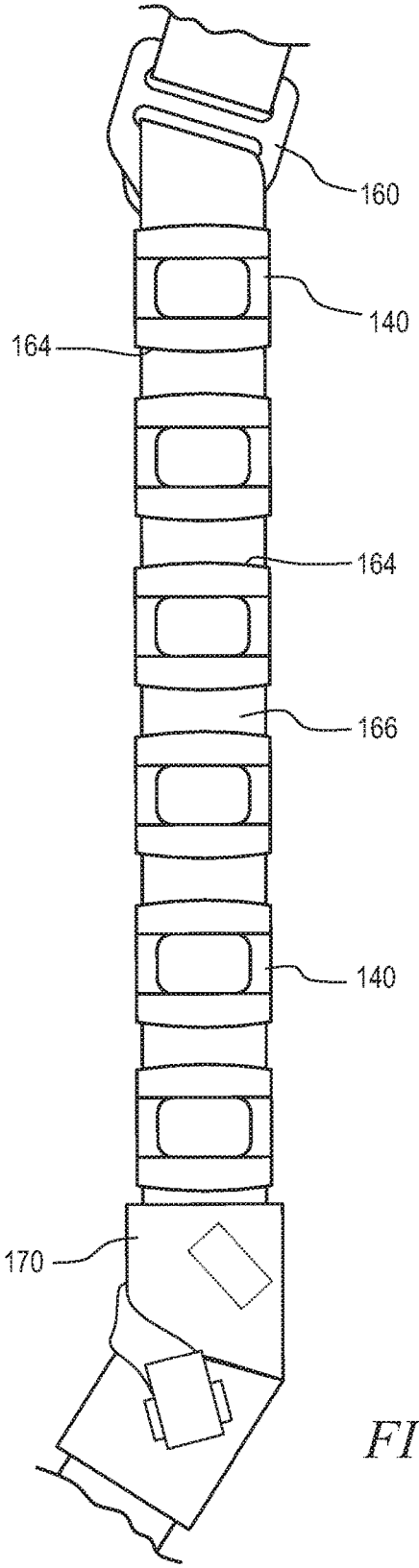
Figure 9:
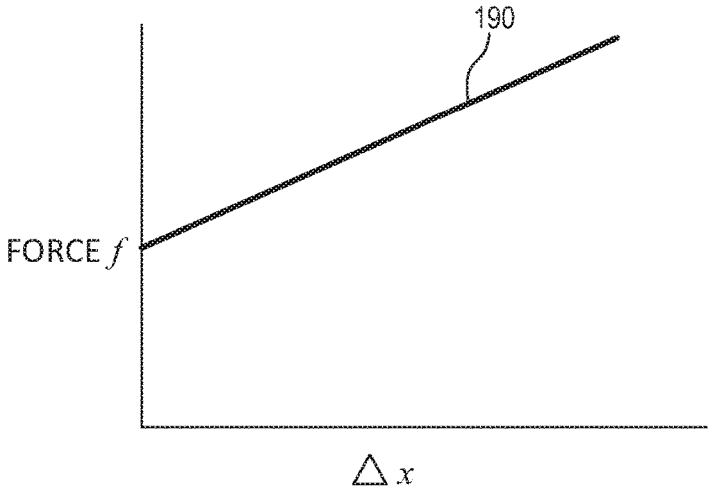
FIG. 9 is a chart of force and motion for the preloaded leg strap arrangement.

FIG. 7*b* shows user 100 in a squatting position to grip and lift load 180 from ground 182. Upon lifting load 180, P2K 102 is in a loaded state in excess of the preloading on straps 138*a* and 138*b*. FIG. 8*b* corresponds to a loaded state of straps 138*a* and 138*b*, i.e., with user 100 squatting to pick up load 180 from ground 182. Blocks 140 are intended to float along strapping 166 and separate from one another under extended stretching of strapping 166 from the position of user 100, as shown in FIG. 8*b*. The counter force to load 180 and weight of user 100 is applied immediately due to preloaded straps 138*a* and 138*b*. Load line 190 in FIG. 9 shows a positive preloading force F on straps 138*a* and 138*b* even with zero $\Delta X$ of P2K 102, i.e., FIG. 7*a*. The squatting motion of user 100 in FIG. 7*b* further stretches preloaded straps 138*a* and 138*b* to increase $\Delta X$ and force F. Accordingly, force F starts at a positive value with preloading ($\Delta X=0$) and continues to increase with the loaded state of FIG. 7*b* with a positive $\Delta X$. While the user 100 only feels this force when stretching the preloaded straps 138*a* and 138*b* such that blocks 140 are no longer contacting each other.

FIG. 7*c* shows user 100 returning to a relaxed state as in FIG. 7*a*, with load 180, straps 138*a* and 138*b* return to the preloaded state of FIG. 8*a*. Blocks 140 again contact on curved ends 164 and straps 166 and remain stretched and under tension due to the preload.

Figure 10:
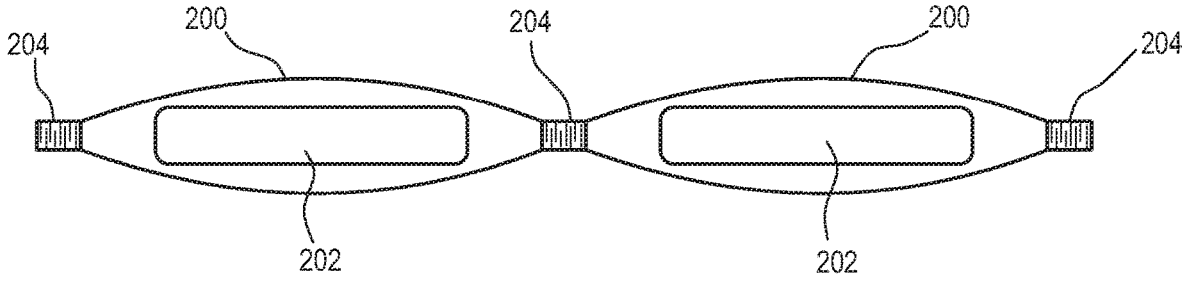
FIG. 10 illustrates an alternate embodiment of the blocks and elastic strapping under tension.

FIG. 10 illustrates an alternate preloaded strap arrangement with strapping 200 under tension even in a relaxed state of P2K 102. Blocks 202 are placed between strapping 200. The portion of strapping 200 between blocks 202 is sewn together at connection points 204 to hold blocks 202 in place. Blocks 202 maintain the preload on strapping 200.

P2K 102 stores potential energy in the preloaded strapping arrangement, e.g., the elastic strapping stretches and stores potential energy when transitioning from a standing position to a crouched, squatting, or seated position. The potential energy in P2K 102 remains available while user 100 is seated or squatting to assist with the opposing motion, i.e., standing up with or without load. When user 100 stands up from the seated position with load 180, similar to FIGS. 7*b*-7*c*, the potential energy in P2K 102 is released to assist the user in the motion. A similar concept applies to user 100 standing from the seated position. P2K 102 reduces the effort, strain, fatigue, and potential for injury associated with such movement in physical labor work environments. P2K 102 is adjustable for size and pre-tensioning the elastic components.

In general, P2K 102 utilizes a flexible, modular, passive strapping system that, in one embodiment, extends from upper torso harness 110 along preloaded straps 138*a* and 138*b* to thigh straps 146 and knee pads 148. P2K 102 further extends from knee pads 148 over the calf area with calf straps 150 to ankle cuffs 152. P2K 102 gains support from upper torso harness 110 and preloaded straps 138*a* and 138*b*, as well as the strapping arrangement around the back of the thigh, front of the knee, and back of the tibia to anchor at the ankle. Because the preloaded straps over the length of the leg, the strapping arrangement stores energy in the elastic bands or springs during the squatting or crouching motion to be released during transition to the standing position thus assisting with human motion under load. The preloaded straps 138*a* and 138*b* also hold P2K 102 in place during various movements, such as squatting.

While one or more embodiments of the present invention have been illustrated in detail, the skilled artisan will appreciate that modifications and adaptations to those embodiments may be made without departing from the scope of the present invention as set forth in the following claims.

What is claimed:

1. A human motion assistance device, comprising:

an upper torso harness configured to attach to an upper torso of a user and including a first backside attachment point and a second backside attachment point;

a leg strap arrangement configured to attach to a leg of the user and including a first backside attachment point and a second backside attachment point; and a preloaded strap arrangement including, (a) a first elastic strap configured to extend behind the user and be coupled between the first backside attachment point on the upper torso harness and the first backside attachment point on the leg strap arrangement, (b) a second elastic strap configured to extend behind the user and be coupled between the second backside attachment point on the upper torso harness and the second backside attachment point on the leg strap arrangement and further coupled to a midpoint of the first elastic strap, (c) a plurality of first blocks serially arranged along the first elastic strap with the first elastic strap extending through an opening in each of the plurality of first blocks, and (d) a plurality of second blocks serially arranged along the second elastic strap with the second elastic strap extending through an opening in each of the plurality of second blocks, wherein the preloaded strap arrangement is passively preloaded under tension with the plurality of first blocks along the first elastic strap in contact with each other and the plurality of second blocks along the second elastic strap in contact with each other setting a minimum preload while the upper torso harness remains in a relaxed state and configured to avoid stress on the user.

2. The human motion assistance device of claim 1, wherein the first elastic strap extending through the opening in each of the plurality of first blocks provides for the plurality of first blocks to move freely along the first elastic strap.

3. The human motion assistance device of claim 1, wherein the plurality of first blocks includes a curved end.

4. The human motion assistance device of claim 1, wherein the leg strap arrangement includes a knee pad.

5. The human motion assistance device of claim 4, wherein the knee pad includes a split seam.

6. The human motion assistance device of claim 5, wherein the split seam includes a magnetic connection or buckle.

7. A human motion assistance device, comprising:

an upper torso harness;

a leg strap arrangement; and a preloaded strap arrangement including, (a) a first elastic strap configured to extend behind a user to couple between a first attachment point on the upper torso harness and a first attachment point on the leg strap arrangement, (b) a second elastic strap configured to extend behind the user to couple between a second attachment point on the upper torso harness and a second attachment point on the leg strap arrangement, (c) a plurality of first blocks serially arranged along the first elastic strap with the first elastic strap extending through an opening in each of the plurality of first blocks, and (d) a plurality of second blocks serially arranged along the second elastic strap with the second elastic strap extending through an opening in each of the plurality of second blocks, wherein the preloaded strap arrangement is passively preloaded under tension by the plurality of first blocks and the plurality of second blocks while the upper torso harness remains in a relaxed state and configured to avoid stress on the user.

8. The human motion assistance device of claim 7, wherein the preloaded strap arrangement includes an X-bracket connected to the upper torso harness.

9. The human motion assistance device of claim 7, wherein the first elastic strap extending through the opening in each of the plurality of first blocks provides for the plurality of first blocks to move freely along the first elastic strap.

10. The human motion assistance device of claim 9, wherein the plurality of first blocks includes a curved end.

11. The human motion assistance device of claim 7, wherein the leg strap arrangement includes a knee pad.

12. The human motion assistance device of claim 11, wherein the knee pad includes a split seam.

13. The human motion assistance device of claim 12, wherein the split seam includes a magnetic connection or buckle.

14. A method of making a human motion assistance device, comprising the steps of:

providing an upper torso harness; and providing a leg strap arrangement; and providing a preloaded strap arrangement including, (a) a first elastic strap configured to extend behind a user to couple between a first attachment point on the upper torso harness and a first attachment point on the leg strap arrangement, (b) a second elastic strap configured to extend behind the user to couple between a second attachment point on the upper torso harness and a second attachment point on the leg strap arrangement, (c) a plurality of first blocks serially arranged along the first elastic strap with the first elastic strap extending through an opening in each of the plurality of first blocks, and (d) a plurality of second blocks serially arranged along the second elastic strap with the second elastic strap extending through an opening in each of the plurality of second blocks, wherein the preloaded strap arrangement is passively preloaded under tension by the plurality of first blocks and the plurality of second blocks while the upper torso harness remains in a relaxed state.

15. The method of claim 14, wherein providing the preloaded strap arrangement includes providing an X-bracket connected to the upper torso harness.

16. The method of claim 15, wherein the first elastic strap extending through the opening in each of the plurality of first blocks provides for the plurality of first blocks to move freely along the first elastic strap.

17. The method of claim 16, wherein the plurality of first blocks includes a curved end.

18. The method of claim 14, wherein providing the leg strap arrangement includes providing a knee pad.

19. The method of claim 18, wherein the knee pad includes a split seam.

20. The method of claim 19, wherein the split seam includes a magnetic connection or buckle.

* * * * *